US007902131B2

(12) United States Patent
Aguilar et al.

(10) Patent No.: US 7,902,131 B2
(45) Date of Patent: Mar. 8, 2011

(54) ANTIOXIDANT SYNERGIST FOR LUBRICATING COMPOSITIONS

(75) Inventors: Gaston A. Aguilar, Milford, CT (US); Brian Stunkel, Stamford, CT (US); Steven G. Donnelly, Bethel, CT (US)

(73) Assignee: R.T. Vanderbilt Company, Inc., Norwalk, CT (US)

( * ) Notice: Subject to any disclaimer, the term of this patent is extended or adjusted under 35 U.S.C. 154(b) by 194 days.

(21) Appl. No.: 11/740,495

(22) Filed: Apr. 26, 2007

(65) Prior Publication Data

US 2007/0254821 A1 Nov. 1, 2007

Related U.S. Application Data

(60) Provisional application No. 60/745,634, filed on Apr. 26, 2006.

(51) Int. Cl.
*C10M 141/02* (2006.01)
*C10M 141/06* (2006.01)
*C10M 141/12* (2006.01)

(52) U.S. Cl. ..... 508/194; 508/189; 508/198; 508/287; 508/486; 508/487; 508/555; 508/563

(58) Field of Classification Search ..... 508/563, 508/556, 555, 188, 189, 459, 486, 528
See application file for complete search history.

(56) References Cited

U.S. PATENT DOCUMENTS

| | | | | |
|---|---|---|---|---|
| 4,389,322 | A * | 6/1983 | Horodysky | 508/194 |
| 4,530,771 | A | 7/1985 | Nakano et al. | |
| 5,498,809 | A | 3/1996 | Emert et al. | |
| 5,773,393 | A * | 6/1998 | Adams | 508/551 |
| 5,885,943 | A * | 3/1999 | Watts et al. | 508/197 |
| RE37,363 | E | 9/2001 | Gatto et al. | |
| 6,333,298 | B1 * | 12/2001 | Waddoups et al. | 508/373 |
| 6,723,685 | B2 | 4/2004 | Hartley et al. | |
| 6,844,300 | B2 * | 1/2005 | Milner et al. | 508/322 |
| 2004/0138073 | A1 | 7/2004 | Karol et al. | |
| 2005/0039381 | A1 * | 2/2005 | Langer et al. | 44/301 |
| 2005/0250655 | A1 * | 11/2005 | Adams et al. | 508/287 |
| 2006/0025313 | A1 | 2/2006 | Boffa | |
| 2006/0079413 | A1 | 4/2006 | Kocsis et al. | |

FOREIGN PATENT DOCUMENTS

| | | | |
|---|---|---|---|
| EP | 36708 | A1 * | 9/1981 |
| EP | 0 036 708 | B1 * | 3/1984 |

OTHER PUBLICATIONS

Vanderbilt Technical Data Vanlube 289.*
Yao, Junbing; "The Interaction of Organic Borate Ester with Other Lubricant Additives"; 2005 Annual Meeting of the Lube Scientific and Technical Information Center, Nanchang, China, Sep. 21-23, 2005, pp. 157-163.
Yao, Junbing; "Recent Development of Antiwear, Extreme Pressure (EP) Additives for Lubricant"; 2005 Annual Meeting of the Lube Scientific and Technical Information Center, Nanchang, China, Sep. 21-23, 2005.

* cited by examiner

*Primary Examiner* — Ellen M McAvoy
*Assistant Examiner* — Pamela Weiss
(74) *Attorney, Agent, or Firm* — Norris Mclaughlin & Marcus, P.A.

(57) ABSTRACT

Molybdenum-free lubricating compositions are provided, having an antioxidation additive composition based on a combination of (1) alkylated diphenylamine (APDA), (2) polyamine dispersant, and (3) monoglyceride, ethoxylated amide, or mixtures thereof. Further synergy is achieved when component (3) is borated, allowing a reduction in phosphorus levels to below 0.08% or even a phosphorus-free composition.

10 Claims, No Drawings

ANTIOXIDANT SYNERGIST FOR LUBRICATING COMPOSITIONS

This application is a nonprovisional of U.S. Ser. No. 60/745,634, filed Apr. 26, 2006.

FIELD OF INVENTION

This invention concerns lubricating compositions having improved resistance to oxidation. Another aspect of the invention relates to antioxidant synergists and their incorporation in lubricating compositions to improve resistance to oxidation thereof.

BACKGROUND OF INVENTION

Engine oils function under severe oxidative conditions. The oxidative breakdown of the engine oil creates sludge and deposits, deteriorates the viscosity characteristics of the oil, and produces acidic bodies that corrode engine parts. To combat the effects of oxidation, engine oils are formulated with an array of antioxidants including hindered phenols, aromatic amines, zinc dithiophosphates (ZDDP), sulfurized hydrocarbons, metal and ashless dithiocarbamates, and organo-molybdenum compounds. Particularly effective antioxidants are alkylated diphenylamines (ADPAs), and ZDDPs. In combination, these two compounds provide the majority the of the antioxidant capacity in engine oils under current practice. However, the use of ZDDP in engine oils is declining due to the poisoning effect of phosphorus on exhaust after-treatment catalyst. In addition, sulfur levels in engine oils are also in decline due to the effect of sulfated ash exhaust after-treatments. Thus, a need exists for effective antioxidant chemistry that can reduce or eliminate the need for phosphorus and sulfur containing antioxidants.

Additionally, organomolybdenum compounds have been used as a component in engine oils as an antioxidant. However, because of the high costs associated with the metal and the impact this cost has on the treat levels and overall cost of the additive packages, there has been an interest within the industry to lessen the dependence on molybdenum based antioxidants. Besides cost however, molybdenum presents problems or concerns with respect to copper/lead bearing corrosion, rust inhibition and particularly with the ball rust test that is part of the GF-4 specification for engine oils. Still further is the concern with respect to the TEOST 33 procedure being proposed for GF-5. That test looks at deposit control under high temperatures and exposure to NOx environments. It has been found that with Mo levels higher than 350 ppm, high levels of deposits are formed, which makes it difficult to formulate an oil that will pass the proposed GF-5 specification. Until now, however, suitable formulations which can obtain the benefits of molybdenum, while avoiding its use, have not been found.

Mono-esters of glycerol or monoglycerides, ethoxylated amides, and borate esters thereof have long been recognize as effective friction reducing and antiwear additives for lubricants as disclosed by U.S. Pat. Nos. 4,389,322, 4,450,771, 5,629,272, which are hereby incorporated herein for reference. Furthermore, these materials have been combined with friction reducing molybdenum compounds to further improve friction reducing capacity of engine oils and thus, improving fuel economy of passenger cars.

In U.S. Pat. No. 6,723,685 B2, Hartley discloses a lubricating oil composition comprising a) an oil of lubricating viscosity having viscosity index of least 96; b) a least one calcium detergent; c) at least organic molybdenum compound; d) at least one organic ashless nitrogen free friction modifier; and e) at least one metal dihydrocarbyldithiophosphate compound, the composition having molybdenum in the amount of least 10 ppm and phosphorus form metal dihydrocarbyldithiophosphate compound in amount up to about 0.1 wt. %. The preferred organic ashless nitrogen is mono-ester of glycerol in which the ester is an oleate. Hartley states that this composition is very effective in reducing fuel consumption in modified Sequence VIB engine test without having detrimental effect of elastomer seals. However, Hartley does not teach that glycerol mono-oleate has antioxidant or deposit control function.

In U.S. Patent Application 2006/0025313 A1, Boffa discloses a low phosphorus lubricating oil composition for internal combustion engines which demonstrates fuel economy benefits while also providing high temperature oxidation, piston deposits, and wear protection. The lubricating oil composition of this invention is comprised of a) major amount of base oil of lubricating viscosity; b) overbased alkaline earth sulfonate detergent, c) 0.02 to 10 wt % of a oxymolybdenum-containing complex, d) from 0.1 to 5 wt % of ester friction modifier; and e) from about 0.2 to 10 wt % of antioxidant selected from group consisting of a diphenylamine type, a sulfurized ester-containing compound and mixtures thereof, wherein phosphorus content of the composition is 0.08 wt % or less. In this invention, the preferred ester friction modifier is borated glycerol mono-oleate. However, Boffa does not teach that ester friction modifier has antioxidant function and relies on both diphenylamine type antioxidants and molybdenum complex to provide oxidation and deposit control protection.

It has been shown that a combination of an alkylated diphenylamine and borated monoglyceride/ethoxylated amide exhibits antioxidant synergy in a lubricating composition. However, this combination alone is not sufficient to provide adequate antioxidant protection where lower levels of phosphorus are used.

The invention herein discloses low phosphorus or phosphorus-free, molybdenum-free lubricating compositions that achieve the same level of oxidation stability as compositions with higher level of phosphorus. By molybdenum-free, it is meant that the lubricating composition is free of molybdenum in any form, whether elemental, or as part of a bound or unbound ion, or as part of an inorganic or organic molecule or complex.

SUMMARY OF THE INVENTION

According to the invention, synergistic antioxidant compositions are disclosed containing (1) alkylated diphenylamine (APDA), (2) polyamine dispersant, and (3) monoglyceride, ethoxylated amide, or mixtures thereof. Monoglyceride is preferably prepared by partial hydrolysis of fatty oil, vegetable oil, triglyceride or other glycerol ester. Ethoxylated amide is prepared by reacting fatty oil, vegetable oil, triglyceride, or other glycerol ester with 3 equivalents of ethoxylated amine. Mixtures of the latter are prepared by partially reacting fatty oil, vegetable oil, triglyceride or other glycerol ester with less than 3 equivalents of ethoxylated amine. In another aspect of the invention, compounds described in (3) are borated to improve antiwear performance without affecting the synergy with ADPA.

Another embodiment of the invention concerns lubricating compositions comprised of a major amount of an oil of lubricating viscosity and an oxidation inhibiting amount of synergistic antioxidant composition containing (1) ADPA, (2) polyamine dispersant, and (3) monoglyceride, ethoxylated amide, or mixtures thereof. In another aspect of the invention, compounds described in (3) are borated to improve antiwear performance without affecting the oxidation stability of the lubricating compositions. A further embodiment concerns lubricating compositions having the above synergistic antioxidant composition in combination with ZDDP. Preferably, the antioxidant composition takes the place of a portion of the ZDDP usually present in such a lubricating composition, so as to achieve effective results with a reduction in phosphorous and sulfur levels.

DETAILED DESCRIPTION OF THE INVENTION

ADPA antioxidants of this invention are secondary diarylamines of the following general formula:

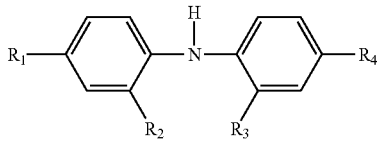

wherein $R_1$, $R_2$, $R_3$, and $R_4$ each independently represent hydrogen, alkyl, aralkyl, aryl, and alkaryl groups having 1 to about 20 carbons atoms per each group. Preferred groups are hydrogen, 2-methyl propenyl, 2,4,4-trimethyl pentenyl, styrenyl, and nonyl.

The second component of synergistic antioxidant compositions disclosed herein is polyamine dispersants based on polyalkenylamine compounds:

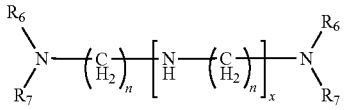

wherein $R_6$ and $R_7$ are independently hydrogen, normal and branched alkyl groups containing 1 to 25 carbon atoms, alkoxy groups containing 1 to 12 carbon atoms, alkylene groups containing 2 to 6 carbon atoms, and hydroxyl or amino alkylene groups containing 2 to 12 carbon atoms, x is 2 to 6, preferably 2 to 4, and n is 0 to 10, preferably 2 to 6. Particularly most preferred are triethylene tetramine, tetraethylene pentamine, and mixtures thereof in which $R_6$ and $R_7$ are both hydrogen, x is 2 to 3, and n is 2.

Polyamine dispersants are prepared by the reaction of polyalkenylamine compounds with carboxylic acids (ROOH) or reactive derivatives thereof; alkyl or alkenyl halides (R—X) and alkyl or alkenyl substituted succinic acid to respectively form carboxylic acid amides, hydrocarbyl substituted polyalkenylamines, and succinimides:

Typical of carboxylic acid amides are those disclose in U.S. Pat. No. 3,405,064, the disclosure of which is incorporated by reference. The products are either mono carboxylic acid amides as shown above or poly carboxylic acid amides in which more than one of the primary and secondary amines (—NH and $NH_2$) are transformed to carboxylic acid amides. The $R_8$ groups in carboxylic acid are 12 to 250 aliphatic carbon atoms. Preferred $R_8$ groups contain 12 to 20 carbon atoms and polyisobutenyl chains containing 72 to 128 carbon atoms.

Typical hydrocarbyl substituted polyalkenylamine compounds are disclosed in U.S. Pat. No. 3,574,576, the disclosure of which is incorporated by reference. The products are mono or poly substituted. Hydrocarbyl groups, $R_9$, are preferably 20 to 200 carbons atoms. Particularly preferred halides used in the formation of hydrocarbyl polyalkenylamine compounds are polyisobutenyl chlorides which contain 70 to 200 carbon atoms.

The preferred polyamine dispersants of this invention are the succinimides which are either mono or bis substituted:

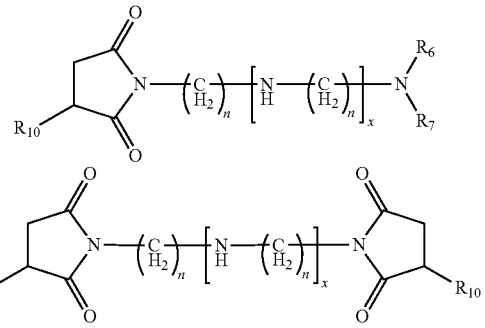

wherein $R_{10}$ is 8 to 400 carbon atoms and preferably 50 to 200 carbon atoms. Particularly preferred are succinimide dispersants which are derived from polyisobutenyl, and polyethyleneamines such as triethylene tetramine, tetraethylene pentamine, and mixtures thereof.

Another type of dispersant is polyamine grafted viscosity index (VI) improvers. Plethora of patents teaching the preparation of these compounds is available. A sampling of this patents which hereby incorporated for reference are U.S. Pat. Nos. 4,089,794; 4,171,273; 4,670,173; 4,517,104; 4,632,769;

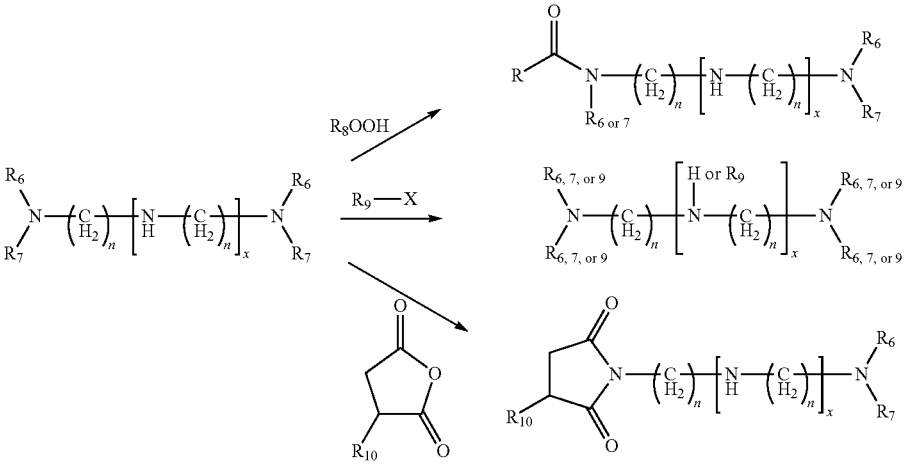

and 5,512,192. Typical preparation involves pre-grafting olefin copolymers with ethylenically unsaturated carboxylic acid materials to produce an acylated VI improver. The acyl groups are then reacted with polyamines to form carboxylic acid amides and succinimides.

Another class of polyamine dispersants is Mannich base compositions. Typical Mannich bases which can be used in this invention are disclosed in U.S. Pat. Nos. 3,368,972, 3,539,663, 3,649,229, and 4,157,309. Mannich bases are typically prepared from alkylphenol having alkyl groups from 9 to 200 carbon atoms, an aldehydes, such formaldehyde and polyalkenylamine compounds, such triethylene tetramine, tetraethylene pentamine, and mixtures thereof.

The third component of the synergistic antioxidant compositions disclosed herein are derived from glyceryl esters, also known as triglycerides:

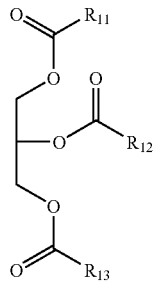

wherein $R_{11}$, $R_{12}$, and $R_{13}$ are independent of each other, and preferably contain at least 8 carbons atoms, and which may contain 22 carbons atoms and higher. Such esters are typically naturally derived and are commonly known as vegetable and animal oils. Particularly useful vegetable oils are coconut, corn, cottonseed, linseed, soybean, and rapeseed. Similarly, animal fatty oils as tallow may be used. These oils are typically converted to antioxidant component of the invention (a) by partial hydrolysis to form monoglyceride compounds as shown by reaction (1), (b) by the reaction with 3 equivalents of ethoxylated amine to form ethoxylated amide compounds as shown by reaction (2), or (c) by the reaction with less than 3 equivalents of ethoxylated amine to form mixtures of (a) and (b) as shown by reaction (3) below:

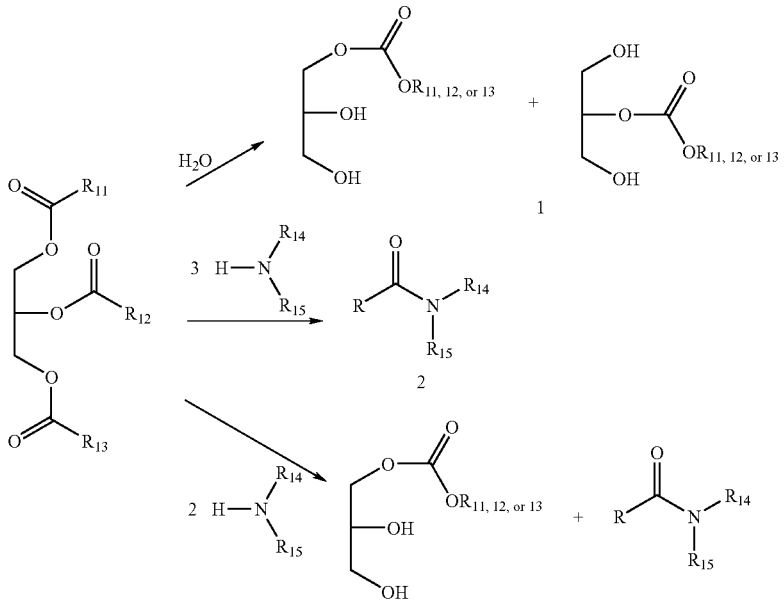

In reactions 2 and 3, $R_{14}$ is an ethoxyl group, i.e. —$CH_2CH2OH$, and $R_{15}$ is ethoxyl group, hydrogen, or an alkyl group of 1 carbon or higher. In reactions 2 and 3, the preferred amine reactant is diethanol amine in which $R_{14}$ and $R_{15}$ are both ethoxyl groups.

Products of reaction 1, 2, and 3 may be further reacted with boric acid to form borate esters of the following form:

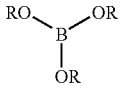

Borated products of reaction 1, 2, and 3 may contain 0.1-2 mass percent boron without adverse effect on the antioxidant synergy. Preparation of the preferred product is set forth in US Patent Application 2004/0138073 A1. Preferred borated ester is Vanlube® 289, which is a commercial product available from R.T. Vanderbilt Company, Inc.

The ADPA component will comprise about 0.1 to 2.5 mass percent of a lubricating composition. Preferably, it will comprise about 0.25 to 1.5 mass percent and most preferably about 0.5 to 1.0 mass percent of a lubricating composition.

The polyamine dispersant component will comprise about 1 to 9 mass percent, preferably about 4.0 to 7 mass percent, and most preferably about 2 to 5 mass percent of a lubricating composition.

Monoglyceride, ethoxylated amide, or mixtures thereof will comprise about 0.05 to 2.0 mass percent of a lubricating composition. Preferably, it will comprise about 0.10 to 1.5 mass percent, and most preferably about 0.15 to 1.0 mass percent of a lubricating composition.

The synergistic antioxidant compositions may be incorporated in any lubricating media by known methods. Any base oil of the lubricating viscosity, as known in the art, can be used in accordance with the present invention, and such a base oil will comprise a major portion, i.e. at least 50% of the lubricating composition. The representative petroleum-based oils are, for example, naphthenic, aromatic, and paraffinic oils. The representative synthetic oils are, for example, polyalkylene glycols, carboxylic acid esters, and poly-α-olefins.

The composition of the invention may be incorporated in the lubricating compositions in amounts effective to produce the desired oxidation inhibiting characteristics. Typically, the amount may range from about 1.1 to 14.0 percent by mass based on total mass of the lubricating compositions. The preferred range is about 2.0 to 7.0 percent of the additive based on the total mass of the lubricating composition.

The lubricating composition may also include phosphorus, preferably by way of a metal dihydrocarbyldithiophosphate, to provide phosphorus levels of 0.01-0.08 mass percent, preferably about 0.03-0.07 mass percent, and most preferred about 0.05%. In addition, based on the invention disclosed herein, particularly where a borated glyceryl ester derivate is present, it is possible to have phosphorus-free lubricating compositions, while still maintaining surprisingly effective antioxidant behavior.

Dihydrocarbyldithiophosphate compounds are usually prepared by reaction $P_2S_5$ with alcohols or phenols to form dihydrocarbyldithiophosphoric acid compounds, which are then neutralized with suitable metal compounds. Examples of metal compounds include, but are not limited to, oxides of zinc, antimony, bismuth, and copper. As mentioned earlier, zinc dihydrocarbyldithiophosphate, ZDDP, is a preferred phosphorus source:

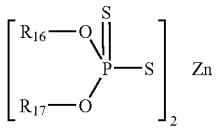

wherein $R_{16}$ and $R_{17}$ are independent hydrocarbyl groups containing 1 to 18 preferably 2 to 12 carbon atoms including alkyl, alkenyl, aryl, arylalkyl, alkylaryl and cycloaliphatic groups. Examples of hydrocarbyl groups are ethyl, n-propyl, isopropyl, n-butyl, isobutyl, sec-butyl, iso-octyl, 2-ethylhexyl, and butylphenyl.

Non-metal dihydrocarbyldithiophosphate compounds may also be used as phosphorus sources to provide antiwear and antioxidant properties. These additives are prepared by addition of dihydrocarbyldithiophosphoric acid to acrylate and maleate compounds to form carboxylic acid esters and succinates respectively:

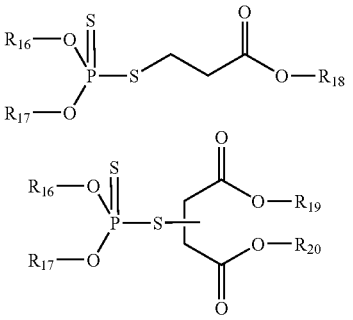

wherein $R_{18}$, $R_{19}$ and $R_{20}$ are independently selected from alkyl groups having 2 to 8 carbon atoms. Commercially available examples are Vanlube® 7611M and Vanlube® 727 from R.T. Vanderbilt Company Inc., and Irgalube® 63 from Ciba Geigy Corporation.

Besides components of the invention, the skilled person will understand that a fully formulated lubricating composition may contain one or more of the following:

1. Additional antioxidants compounds
2. Additional friction modifier besides glyceryl based ester and amide antioxidant synergist described herein
3. Additional extreme pressure/anti-wear additives
4. Viscosity modifiers
5. Pour point depressants
6. Detergents
7. Antifoaming agents
8. Rust Inhibitors
9. Corrosion Inhibitors 1. Additional Antioxidant Compounds Other antioxidant may be used in the compositions of the present invention, if desired. Typical antioxidants include hindered phenolic antioxidants, sulfurized phenolic antioxidants, oil-soluble copper compounds, phosphorus-containing antioxidants, organic sulfides, disulfides and polysulfides, and dialkyl dithiocarbamate compounds such methylene bis (dibutyldithiocarbamate) and metal complexes such as copper, zinc, bismuth and antimony dialkyldithiocarbamates.

Illustrative sterically hindered phenolic antioxidants include orthoalkylated phenolic compounds such as 2,6-di-tert-butylphenol, 4-methyl-2,6-di-tert-butylphenol, 2,4,6-tri-tert-butylphenol, 2-tert-butylphenol, 2,6-disopropylphenol, 2-methyl-6-tert-butylphenol, 2,4-dimethyl-6-tert-butylphenol, 4-(N,N-dimethylaminomethyl)-2,8-di-tert-butylphenol, 4-ethyl-2,6-di-tert-butylphenol, 2-methyl-6-styrylphenol, 2,6-distyryl-4-nonylphenol, and their analogs and homologs. Mixtures of two or more such mononuclear phenolic compounds are also suitable.

Other preferred phenol antioxidants for use in the compositions of this invention are methylene-bridged alkylphenols, and these can be used singly or in combinations with each other, or in combinations with sterically hindered un-bridged phenolic compounds. Illustrative methylene-bridged compounds include 4,4'-methylenebis(6-tert-butyl o-cresol), 4,4'-methylenebis(2-tert-amyl-o-cresol), 2,2'-methylenebis(4-methyl-6-tert-butylphenol), 4,4'-methylenebis(2,6-di-tert-butylphenol) and similar compounds. Particularly preferred are mixtures of methylene-bridged alkylphenols such as are described in U.S. Pat. No. 3,211,652, which is incorporated herein by reference.

Another useful type of antioxidant for preferred inclusion in the compositions of the invention are one or more liquid, partially sulfurized phenolic compounds such as are prepared by reacting sulfur mono-chloride with a liquid mixture of phenols—at least about 50 weight percent of which mixture of phenols is composed of one or more reactive, hindered phenols—in proportions to provide from about 0.3 to about 0.7 gram atoms of sulfur mono-chloride per mole of reactive, hindered phenol so as to produce a liquid product. Typical phenol mixtures useful in making such liquid product compositions include a mixture containing by weight about 75% of 2,6-di-tert-butylphenol, about 10% of 2-tert-butylphenol, about 13% of 2,4,6-tri-tert-butylphenol, and about 2% of 2,4-di-tert-butylphenol. The reaction is exothermic and thus is preferably kept within the range of about 15° C. to about 70° C., most preferably between about 40° C. to about 60° C.

Another useful type of antioxidant are 2,2,4-trimethyl-1,2-dihydroquinoline (TMDQ) polymers and homologs containing aromatized terminal units such as those described in U.S. Pat. No. 6,235,686, which is hereby incorporated by reference.

Mixtures of different antioxidants may also be used. One suitable mixture is comprised of a combination of: (i) an oil-soluble mixture of at least three different sterically hindered tertiary butylated monohydric phenols, which is in the liquid state at 25° C.; (ii) an oil-soluble mixture of at least three different sterically-hindered, tertiary butylated methylene-bridged polyphenols; and (iii) at least one bis(4-alkylphenyl) amine wherein the alkyl group is a branched alkyl group having 8 to 12 carbon atoms, the proportions of (i), (ii) and (iii) on a weight basis falling in the range of 3.5 to 5.0 parts of component (i) and 0.9 to 1.2 parts of component (ii) per part by weight of component (iii), as disclosed in U.S. Pat. No. 5,328,619, which is incorporated herein by reference. Other useful preferred antioxidants are those included in the disclosure of U.S. Pat. No. 4,031,023, which is herein incorporated by reference.

2. Friction Modifiers

Friction modifiers are also well known to those skilled in the art. A useful list of friction modifiers is included in U.S. Pat. No. 4,792,410, which is incorporated herein by reference. U.S. Pat. No. 5,110,488 discloses metal salts of fatty acids and especially zinc salts and is incorporated herein by reference. Useful friction modifiers include fatty phosphites, fatty acid amides, fatty epoxides, borated fatty epoxides, fatty amines, metal salts of fatty acids, sulfurized olefins, fatty imidazolines, molybdenum dithiocarbamates (e.g., U.S. Pat. No. 4,259,254, incorporated herein by reference), molybdate esters (e.g., U.S. Pat. No. 5,137,647 and U.S. Pat. No. 4,889,647, both incorporated herein by reference), molybdate amine with sulfur donors (e.g., U.S. Pat. No. 4,164,473 incorporated herein by reference), and mixtures thereof.

Friction modifiers also include metal salts of fatty acids. Preferred cations are zinc, magnesium, calcium, and sodium and any other alkali or alkaline earth metals may be used. The salts may be overbased by including an excess of cations per equivalent of amine. The excess cations are then treated with carbon dioxide to form the carbonate. The metal salts are prepared by a suitable salt with the acid to form the salt, and where appropriate adding carbon dioxide to the reaction mixture to form the carbonate of any cation beyond that needed to form the salt. A preferred friction modifier is zinc oleate.

3. Extreme Pressure/Antiwear Agents

The lubricating compositions can also preferably include at least one phosphorus acid, phosphorus acid salt, phosphorus acid ester or derivative thereof including sulfur-containing analogs preferably in the amount of 0.002-1.0 weight percent. The phosphorus acids, salts, esters or derivatives thereof include compounds selected from phosphorus acid esters or salts thereof, phosphites, phosphorus-containing amides, phosphorus-containing carboxylic acids or esters, phosphorus containing ethers and mixtures thereof.

The amine salts of alkyl phosphates are prepared by known methods, e.g., a method disclosed in U.S. Pat. No. 4,130,494, incorporated herein by reference. A suitable mono- or di-ester of phosphoric acid or their mixtures is neutralized with an amine. When mono-ester is used, two moles of the amine will be required, while the di-ester will require one mole of the amine. In any case, the amount of amine required can be controlled by monitoring the neutral point of the reaction where the total acid number is essentially equal to the total base number. Alternately, a neutralizing agent such as ammonia or ethylenediamine can be added to the reaction.

The preferred phosphate esters are aliphatic esters, among others, 2-ethylhexyl, n-octyl, and hexyl mono- or dieters. The amines can be selected from primary or secondary amines. Particularly preferred are tert-alkyl amines having 10 to 24 carbon atoms. These amines are commercially available as, for example, Primene® 81R manufactured by Rohm and Haas Co.

4. Viscosity Modifiers

Viscosity modifiers and dispersant viscosity modifiers are well known. Examples of viscosity modifiers and dispersant viscosity modifiers are polymethacrylates, polyacrylates, polyolefins, styrene-maleic ester copolymers, and similar polymeric substances including homopolymers, copolymers and graft copolymers. Examples of commercially available viscosity modifiers, dispersant viscosity modifiers and their chemical types are listed below. The dispersant viscosity modifiers are designated by a (D) after their number. Representative viscosity modifiers that are commercially available are listed below in Table 1.

5. Pour Point Depressants (PPD)

These components are particularly useful to improve low temperature qualities of lubricating oil. A preferred pour point depressant is an alkylnaphthalene. Pour point depressants are disclosed in U.S. Pat. Nos. 4,880,553 and 4,753,745, which are incorporated herein by reference. Pour point depressants are commonly applied to lubricating compositions to reduce viscosity measured at low temperatures and low rates of shear. The pour point depressants are preferably used in the range of 0.1-5 weight percent. Examples of tests used to access low temperature, low shear rate rheology of lubricating fluids include ASTM D97 (pour point), ASTM D2983 (Brookfield viscosity), D4684 (Mini-rotary Viscometer) and D5133 (Scanning Brookfield).

Examples of commercially available pour point depressants and their chemical types are listed in Table 2.

TABLE 1

| Viscosity Modifier | Trade name | Commercial Source |
|---|---|---|
| 1. Polyisobutylenes | Indopol ® | Amoco |
| | Parapol ® | Exxon (Paramins) |
| | Polybutylene ® | Chevron |
| | Hyvis ® | British Petroleum |
| 2. Olefin copolymers | Lubrizol ® 7060, 7065, 7067 | Lubrizol |
| | Paratone ® 8900, 8940, 8452, 8512 | Exxon |
| | ECA-6911 | Exxon (Paramins) |
| | TLA 347, 555(D), 6723(D) | Texaco |
| | Trilene ® CP-40, CP-60 | Uniroyal |
| 3. Hydrogenated styrenediene copolymers | Shellvis ® 50, 40 | Shell |
| | LZ ® 7341, 7351, 7441 | Lubrizol |
| 4. Styrene, maleate copolymers | LZ ® 3702(D), 3715, 3703(D) | Lubrizol |
| 5. Polymethacrylates (PMA) | Acryloid ® 702, 954(D), 985(D), 1019, 1265(D) | Rohm GmbH |
| | TLA 388, 407, 5010(D), 5012(D) | Texaco |
| | Viscoplex ® 4-950(D), 6-500(D), 1515 | Rohm GmbH |
| 6. Olefin-graft PMA polymer | Viscoplex ® 2-500, 2-600 | Rohm GmbH |
| 7. Hydrogenated polyisoprene star polymers | Shellvis ® 200, 260 | Shell |

Summaries of viscosity modifiers can be found in U.S. Pat. Nos. 5,157,088, 5,256,752 and 5,395,539, which are incorporated herein by reference.

TABLE 2

| Pour Point Depressant | Trade name | Source |
|---|---|---|
| Polymethacrylates | Acryloid 154-70, 3003, 3007 | Rohm & Haas |
| | LZ ® 7749B, 7742, 7748 | Lubrizol |
| | TC 5301, 10314 | Texaco |
| Vinyl acetate/fumarate or maleate copolymers | ECA 11039, 9153 | Exxon (Paramins) |
| Styrene, maleate copolymers | LZ ® 662 | Lubrizol |

6. Detergents

Lubricating compositions in many cases also preferably include detergents. Detergents as used herein are preferably metal salts of organic acids. The organic acid portion of the detergent is preferably a sulfonate, carboxylate, phenate, or salicylate. The metal portion of the detergent is preferably an alkali or alkaline earth metal. Preferred metals are sodium, calcium, potassium and magnesium. Preferably, the detergents are overbased, meaning that there is a stoichiometric excess of metal over that needed to form the neutral metal salt.

Preferred overbased organic salts are the sulfonate salts having a substantially lipophilic character and which are formed from organic materials. Organic sulfonates are well known materials in the lubricant and detergent arts. The sulfonate compound should preferably contain on average from about 10 to about 40 carbon atoms, more preferably from about 12 to about 36 carbon atoms and most preferably from about 14 to about 32 carton atoms on average. Similarly, the phenates, oxylates and carboxylates preferably have a substantially lipophilic character.

While the present invention allows for the carbon atoms to be either aromatic or in paraffinic configuration, it is highly preferred that alkylated aromatics be employed. While naphthalene based materials may be employed, the aromatic of choice is the benzene moiety.

The one particularly preferred component is thus overbased mono-sulfonated alkylated benzene, and is preferably the mono-alkylated benzene. Preferably, alkyl benzene fractions are obtained from still bottom sources and are mono- or di-alkylated. It is believed, in the present invention, that the mono-alkylated aromatics are superior to the dialkylated aromatics in overall properties.

It is preferred that a mixture of mono-alkylated aromatics (benzene) be utilized to obtain the mono-alkylated salt (benzene sulfonate) in the present invention. The mixtures wherein a substantial portion of the composition contains polymers of propylene as the source of the alkyl groups assist in the solubility of the salt. The use of mono-functional (e.g., mono-sulfonated) materials avoids crosslinking of the molecules with less precipitation of the salt from the lubricant. It is preferred that the salt be overbased. The excess metal from over-basing has the effect of neutralizing acids, which may build up in the lubricant. A second advantage is that the overbased salt increases the dynamic coefficient of friction. Preferably, the excess metal will be present over that which is required to neutralize the acids at about in the ratio of up to about 30:1, preferably 5:1 to 18:1 on an equivalent basis.

The amount of the overbased salt utilized in the composition is preferably from about 0.1 to about 10 weight percents on an oil free basis. The overbased salt is usually made up in about 50% oil with a TBN range of 10-600 on an oil free basis. Borated and non-borated overbased detergents are described in U.S. Pat. Nos. 5,403,501 and 4,792,410, which are herein incorporated by reference for disclosure pertinent hereto.

7. Antifoaming Agent

Antifoaming agents are well known in the art as silicone or fluorosilicone compositions. Such antifoam agents are available from Dow Corning Chemical Corporation and Union Carbide Corporation. A preferred fluorosilicone antifoam product is Dow FS-1265. Preferred silicone antifoam products are Dow Corning DC-200 and Union Carbide UC-L45. Other antifoam agents which may be included in the composition either alone or in admixture is a polyacrylates antifoam agent available from Monsanto Polymer Products Co. of Nitro, W. Va. known as PC-1244. Also, a siloxane polyether copolymer antifoam agent available from OSI Specialties, Inc. of Farmington Hills, Mich. may also be included. One such material is sold as SILWET-L-7220. The antifoam products are preferably included in the compositions of this invention at a level of 5 to 80 parts per million with the active ingredient being on an oil-free basis.

8. Corrosion Inhibitors

Embodiments of rust inhibitors include metal salts of alkylnapthalenesulfonic acids. Embodiments of copper corrosion inhibitors that may optionally be added include thiazoles, triazoles and thiadiazoles. Example embodiments of such compounds include benzotriazole, tolyltriazole, octyltriazole, decyltriazole, dodecyltriazole, 2-mercapto-benzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis (hydrocarbylthio)-1,3,4-thiadiazoles, and 2,5-bis (hydrocarbyldithio)-1,3,4-thiadiazoles.

The following examples are given for the purpose of illustrating the invention and are not intended to limit the invention. All data is based on mass percent unless otherwise indicated.

Oxidation Stability Testing

Oxidation stability was measured by pressurized differential scanning calorimetry (PDSC) as described by ASTM D 6186. PDSC measures oxidation stability by detecting exothermic release of heat when antioxidant capacity of a lubricating composition is depleted and the base oil goes into oxidative chain reaction known as auto-oxidation. The time from the start of the experiment to auto-oxidation is known as the oxidation induction time (OIT). Thus, longer OITs indicate greater oxidative stability and antioxidant capacity.

Example A

The following example, with data set forth in Table A, shows antioxidant synergism that exists between ADPA, $C_{6-18}$ monoglyceride and di-ethoxylated amide mixture and mono succinimide dispersant derived from polyethyleneamines and polyisobutylene succinic anhydride dissolved in 35 to 50 mass percent solvent de-waxed heavy paraffinic petroleum distillates. The $C_{6-18}$ monoglyceride and di-ethoxylated amide mixture prepared by reacting 1 mole coconut oil with approximately 2.0 moles of diethanol amine,

TABLE A

| | 1 | 2 | 3 | 4 | 5 |
|---|---|---|---|---|---|
| $C_{6-18}$ Monoglyceride/ Di-Ethoxylated Amide Mixture (3:7 mass percent ratio) | | | 1 | 0.5 | 0.5 |
| Vanlube 961[1] | | 1 | | 0.5 | 0.5 |
| Mono Succinimide Dispersant | 5 | 5 | 5 | | 5 |
| Durasyn 166[2] | 95 | 94 | 94 | 99 | 94 |
| PDSC OIT at 180° C. | | | | | |
| Minutes | 5.4 | 41.4 | 5.2 | 44.5 | 67 |

[1]Vanlube ® 961 is ADPA available from R. T. Vanderbilt Company, Inc.

[2]Durasyn ® 166 is synthetic poly-α-olefin base oil.

Example B

The following example, with data set forth in Table B, shows antioxidant synergisms that exist between ADPA, mono succinimide dispersant, and monoglyceride, di-ethoxylated amide, or mixtures thereof in the presence of phosphorus in the form of ZDDP. Data shows that the glycerol carboxylate, di-ethoxylated amide and mixtures thereof are useful in recovering antioxidant capacity lost when phosphorus levels are reduced.

TABLE B

| | 6 | 7 | 8 | 9 | 10 | 11 |
|---|---|---|---|---|---|---|
| $C_{6-18}$ Monoglyceride/ Ethoxylated Amide Mixture (3:7 mass ratio) | | | 0.5 | 0.5 | | |
| $C_{6-18}$ Monoglyceride/ Di-Ethoxylated | | | | | 0.15 | |
| $C_{6-18}$ Di-ethoxylated Amide | | | | | | 0.35 |
| Vanlube 961 | 0.5 | 0.5 | | 0.5 | 0.5 | 0.5 |
| Mono succinimide Dispersant | 5 | 5 | 5 | 5 | 5 | 5 |
| Durasyn 166 | 93.7 | 94 | 94 | 93.5 | 93.85 | 93.65 |
| ZDDP | 0.9 | 0.5 | 0.5 | 0.5 | 0.5 | 0.5 |
| Phosphorus Content | 0.08 | 0.047 | 0.047 | 0.047 | 0.047 | 0.047 |
| | PDSC OIT at 180° C. | | | | | |
| Minutes | 203 | 165 | 19.3 | 227 | 227.3 | 203 |

Example C

The following example, with data in Table C, shows antioxidant synergism that exists between ADPA, polyamine dispersant and borated monoglyceride/di-ethoxylated amide mixture in the presence of phosphorus (by way of ZDDP). Data shows that the glycerol carboxylate/di-ethoxylated amide mixture is useful in recovering antioxidant capacity lost when phosphorus levels are reduced, and also demonstrates that acceptable antioxidant capacity is achieved even where phosphorus is eliminated. In addition, the data serve to demonstrate the particular synergy of the 3-component system, compared to a system lacking the dispersant (compare test 18 v. test 17). Even without phosphorus, the 3-component system shows a PDSC OIT result at 81.1, which is above the acceptable minimum of about 55.

TABLE C

| | 12 | 13 | 14 | 15 | 16 | 17 | 18 | 19 | 20 | 21 |
|---|---|---|---|---|---|---|---|---|---|---|
| Vanlube 289[8] | 1 | 1 | | | | 0.5 | 0.5 | 1.0 | 0.5 | 1.0 |
| Vanlube 961 | | | 0.5 | 1 | 1 | 0.5 | 0.5 | 0.5 | 0.5 | 0.5 |
| Mono Succinimide Dispersant | | 5 | | | 5 | | 5 | 5 | 5 | 5 |
| Durasyn 166 | 99 | 96 | 99.5 | 99 | 94 | 99 | 96 | 93.6 | 93.5 | 93 |
| ZDDP | | | | | | | | | 0.5 | 0.5 |
| Phosphorus Content | 0 | 0 | 0 | 0 | 0 | 0 | 0 | 0 | 0.047 | 0.047 |
| | PDSC OIT at 180° C. | | | | | | | | | |
| Minutes | 7.3 | 7.3 | 26.1 | 36.5 | 41.4 | 52.7 | 81.1 | 133 | 203 | 250.4 |

[8]Vanlube ® 289 is borated monoglyceride/di-ethoxylated amide mixture (3:7 mass ratio). It contains 1% boron by weight, and it is available from R. T. Vanderbilt Company, Inc.

Deposit Control Testing

A test was conducted to measure deposit forming tendencies for automotive engine oils is the TEOST MHT4 (Thermo-oxidation Engine Oil Simulation Test Moderately High Temperature). In this test, engine oil treated with an oxidation catalyst is continuously cycled down the outside of pre-weighed wire round rod, which is incased by a glass mantel. The rod is resistively heated to obtain maximum temperature of 285° C., and oil is cycled for 24 hours with dry air flowing through the glass mantle in casing at rate of 10 mL/min. At the end of 24 hours, the rod is rinsed with solvent to remove residue oil, and then dried. The mass of deposits on the rod, in addition to any deposits that came off the rod during rinsing, are weighed and compared to the weight of rod before the test. ILSAC GF-4 specifications for engine oils require that total deposits be 35 mg or less.

Example D

Three fully formulated 5W-20 engine oils were tested by PDSC and TEOST MHT4. Engine Oil A contains polyamine dispersant at a level typical of use in engine oils, ADPA at 0.5 mass percent), and ZDDP to provide the oil with 0.1 mass percent phosphorus. Engine Oil B is the same as Engine A, but contains less ZDDP to provide the oil only 0.05 mass percent phosphorus. Engine Oil C is the same as Engine Oil B, but Engine Oil C contains 1.0 mass percent of Vanlube 289, the borated monoglyceride/di-ethoxylated amide mixture. The results in Table D confirm that the components of this invention are useful in formulating molybdenum-free, low phosphorus engine oils (P<0.08 mass percent) which excel in both antioxidant and deposit control characteristics.

TABLE D

| Test Method | Engine Oil A | Engine Oil B | Engine C |
|---|---|---|---|
| PDSC OIT at 180° C., (minutes) | 311.3 | 114.6 | 384.7 |
| TEOST MHT4 total deposits, (mg) | 43.1 | 55.0 | 39.6 |

What is claimed is:

1. A lubricating composition, comprising:

a major portion of a lubricating base oil, and an additive composition comprising, as a percentage of the lubricating composition:

(1) an alkylated diphenylamine, at about 0.25 to about 1.0 mass %, of the following formula

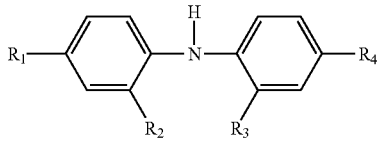

wherein $R_1$ is chosen from alkyl and alkaryl groups having from 4 to 9 carbons atoms per each group, $R_4$ is chosen from hydrogen, alkyl and alkaryl groups having from 4 to 9 carbons atoms per each group, and $R_2$ and $R_3$ are each hydrogen;

(2) a 3:7 mass ratio mixture of $C_6$-$C_{18}$ monoglyceride and $C_6$-$C_{18}$ di-ethoxylated amide, at about 0.5 to about 2.0 mass %; and (3) a monosuccinimide or di-succinimide dispersant, at about 2 to about 5 mass %;

wherein the lubricating composition is free of molybdenum, and wherein the phosphorus level in the lubricating composition is from 0 to less than 0.08 mass %.

2. The lubricating composition of claim 1, further comprising phosphorus at between about 0.01 up to 0.08 mass %.

3. The lubricating composition of claim 2, comprising phosphorus at about 0.03-0.07 mass %.

4. The lubricating composition of claim 1, wherein the lubricating composition is free of phosphorus.

5. A lubricating composition, comprising:

a major portion of a lubricating base oil, and an additive composition comprising, as a percentage of the lubricating composition:

(1) an alkylated diphenylamine, at about 0.25 to about 1.0 mass %, of the following formula

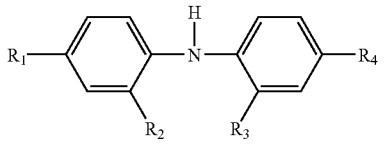

wherein $R_1$ is chosen from alkyl and alkaryl groups having from 4 to 9 carbons atoms per each group, $R_4$ is chosen from hydrogen, alkyl and alkaryl groups having from 4 to 9 carbons atoms per each group, and $R_2$ and $R_3$ are each hydrogen;

(2) a 3:7 mass ratio of a borated mixture of $C_6$-$C_{18}$ monoglyceride and $C_6$-$C_{18}$ di-ethoxylated amide, at about 0.5 to about 2.0 mass %; and (3) a monosuccinimide or di-succinimide dispersant, at about 2 to about 5 mass %;

wherein the lubricating composition is free of molybdenum, and wherein the phosphorus level in the lubricating composition is from 0 to less than 0.08 mass %.

6. The lubricating composition of claim 5, further comprising phosphorus at between about 0.01 up to 0.08 mass %.

7. The lubricating composition of claim 6, comprising phosphorus at about 0.03-0.07 mass %.

8. The lubricating composition of claim 5, wherein the lubricating composition is free of phosphorus.

9. The lubricating composition of claim 1, wherein the $R_1$ and $R_4$ are independently chosen from 2-methyl propenyl, 2,4,4-trimethyl pentenyl and nonyl groups.

10. The lubricating composition of claim 5, wherein the $R_1$ and $R_4$ are independently chosen from 2-methyl propenyl, 2,4,4-trimethyl pentenyl and nonyl groups.

* * * * *